US007575225B1

(12) United States Patent
Saldana

(10) Patent No.: US 7,575,225 B1
(45) Date of Patent: Aug. 18, 2009

(54) SECURITY FENCE CAP

(76) Inventor: Denis Saldana, 8801 Airline Dr., Houston, TX (US) 77037

( * ) Notice: Subject to any disclaimer, the term of this patent is extended or adjusted under 35 U.S.C. 154(b) by 0 days.

(21) Appl. No.: 11/893,247

(22) Filed: Aug. 15, 2007

Related U.S. Application Data

(63) Continuation of application No. 11/120,536, filed on May 3, 2005, now abandoned.

(51) Int. Cl.
*E04H 17/00* (2006.01)

(52) U.S. Cl. ..... 256/11; 256/1

(58) Field of Classification Search ..... 256/1, 256/2, 11; D25/1, 35; 52/101; 2/6.6
See application file for complete search history.

(56) References Cited

U.S. PATENT DOCUMENTS 563,509 A * 7/1896 Sandoe ..... 256/11
D245,870 S * 9/1977 Dougherty ..... D25/135
4,815,235 A * 3/1989 Faltinowski ..... 52/101
4,833,729 A * 5/1989 Fox et al. ..... 441/102
6,226,933 B1 * 5/2001 Nelson et al. ..... 52/101
6,254,314 B1 * 7/2001 Park et al. ..... 405/255
6,640,506 B2 * 11/2003 Landers ..... 52/101
7,032,889 B1 * 4/2006 Moss et al. ..... 256/11

* cited by examiner

*Primary Examiner*—Michael P Ferguson
(74) *Attorney, Agent, or Firm*—Goldstein Law Offices P.C.

(57) ABSTRACT

A security fence cap, for use with a security fence having a post having a post top. The cap has a cylindrical collar and a domed portion. The collar has a lower opening for securing onto the post top and set screws for tightening against the post. The domed portion extends fully over the post top and has a plurality of spike protrusions, selectively attached within threaded radial bores, extending radially outwardly from the domed portion.

1 Claim, 3 Drawing Sheets

SECURITY FENCE CAP

CROSS REFERENCES AND RELATED SUBJECT MATTER

This application is a continuation of patent application Ser. No. 11/120,536, filed in the United States Patent Office on May 3, 2005 now abandoned.

BACKGROUND OF THE INVENTION

The invention relates to a security fence cap. More particularly, the invention relates to a fence cap that is configured to work in conjunction with a security fence to prevent persons from climbing over the fence.

Conventional security fences employ barbed wire, razor wire, and other sharp adaptations that threaten to injure any person that dare climb them. Accordingly, these fences act as an effective deterrent to prevent burglaries, prison escapes, and trespassing.

Security fences are typical built upon the framework of a standard chain-link fence. The chain-link fence is constructed by driving cylindrical, pipe-like, metal posts into the ground, connecting the posts with upper rails and lower rails, and then stringing and securing a continuous chain link mesh between the posts. To create the security fence then, barbed wire or razor wire is strung horizontally above the upper rail to stop a person from climbing over the fence. In the case of razor wire, sharpened loops are often arranged above the upper rail in an overlapping pattern that seeks to prevent any opening through which a person could traverse.

The weak link in this system, however, is the cap standardly provided on the top of the fence posts. The cap is typically dome shaped, and potentially provides a hand-hold for a person seeking to evade the security features of the fence.

U.S. Pat. No. 1,033,322 to Hough discloses a fence post having a spike-like top.

U.S. Pat. No. 4,103,875 discloses a spear point for a fence structure. Glass appears to be intended to bond to a fence having a plurality of vertical metallic posts having rectangular top portions.

U.S. Pat. No. 5,062,612 to Mincher discloses a security rail that includes a plurality or barbed protrusions. Mincher is designed to be attached to the top edge of a wall or the frame of a framed fence.

U.S. Pat. No. 6,076,807 to Spence discloses a fence or deck post cap.

While these units may be suitable for the particular purpose employed, or for general use, they would not be as suitable for the purposes of the present invention as disclosed hereafter.

SUMMARY OF THE INVENTION

It is an object of the invention to produce a security fence cap that prevents a person from grabbing onto the post while climbing a fence. Accordingly, the fence cap has a plurality of spiked protrusions extending radially outwardly therefrom.

It is another object of the invention to provide a security fence cap that easily installs atop a standard fence post. Accordingly, the cap has a lower surface with a post opening for accommodating the upper end of the post, and at least one set screw for fastening to that post.

It is a further object of the invention to provide a security fence cap that can be installed without injuring the installer. Accordingly, the fence cap includes a domed portion with a plurality of threaded radial holes that each allow the spiked protrusions to be installed into the domed portion subsequent to the installation of the cap onto the fence post.

The invention is a security fence cap, for use with a security fence having a post having a post top. The cap has a cylindrical collar and a domed portion. The collar has a lower opening for securing onto the post top and set screws for tightening against the post. The domed portion extends fully over the post top and has a plurality of spike protrusions, selectively attached within threaded radial bores, extending radially outwardly from the domed portion.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
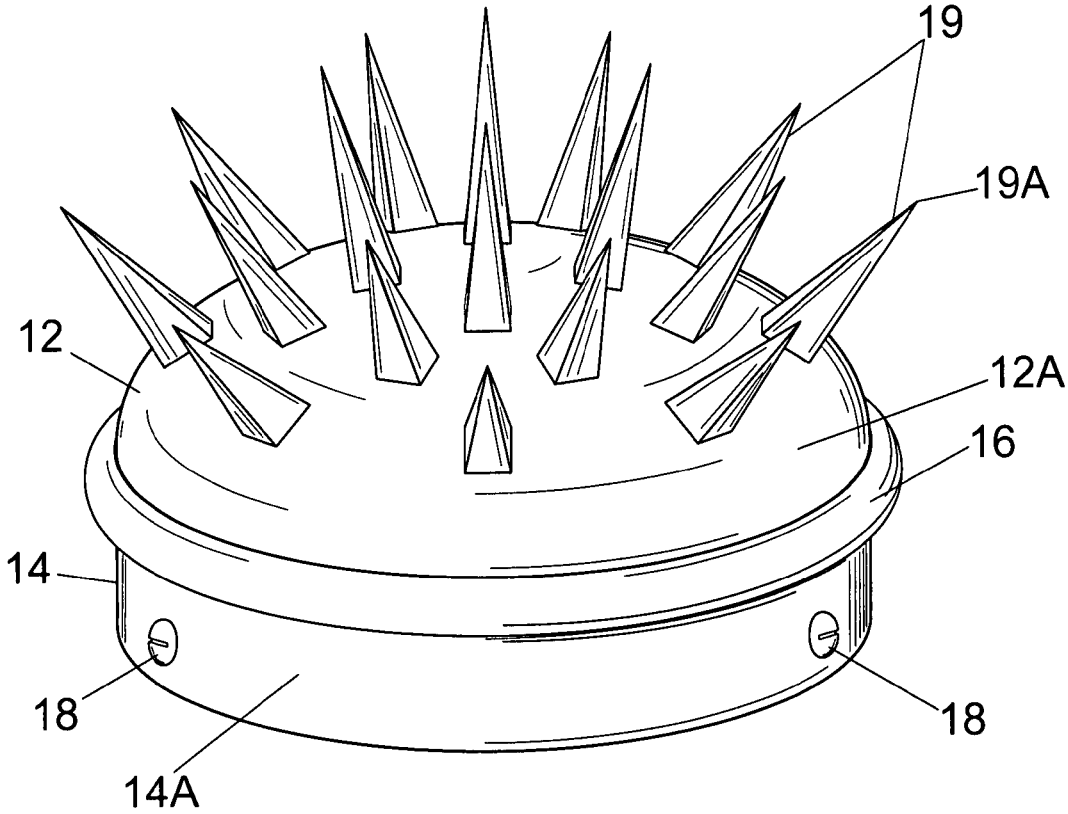
FIG. 1 is a diagrammatic perspective view, illustrating a security fence cap, according to the present invention.

FIG. 1 illustrates a security fence cap 10 according to the present invention. The security fence cap 10 includes a domed portion 12 having an outer surface 12A, and a cylindrical collar 14. The outer surface 12A is semispherical, said semispherical surface having a center. The domed portion 12 is attached to the cylindrical collar 14 at an intermediate ring 16. The collar 14 has an external surface 14A and has plurality of set screws 18 extending radially inward from the external surfaced 14A. A plurality of spiked protrusions 19 each individually extends radially outward from the outer surface 12A of the domed portion 12. As illustrated in the drawings, that the spiked protrustions 19 extend radially outward from the outer surface 12A means that they extend virtually from the center of the semispherical surface of the domed portion 12. Each of the spiked protrusions 19 have a point 19A fully opposite from the outer surface 12A of the domed portion 12.

Figure 2:
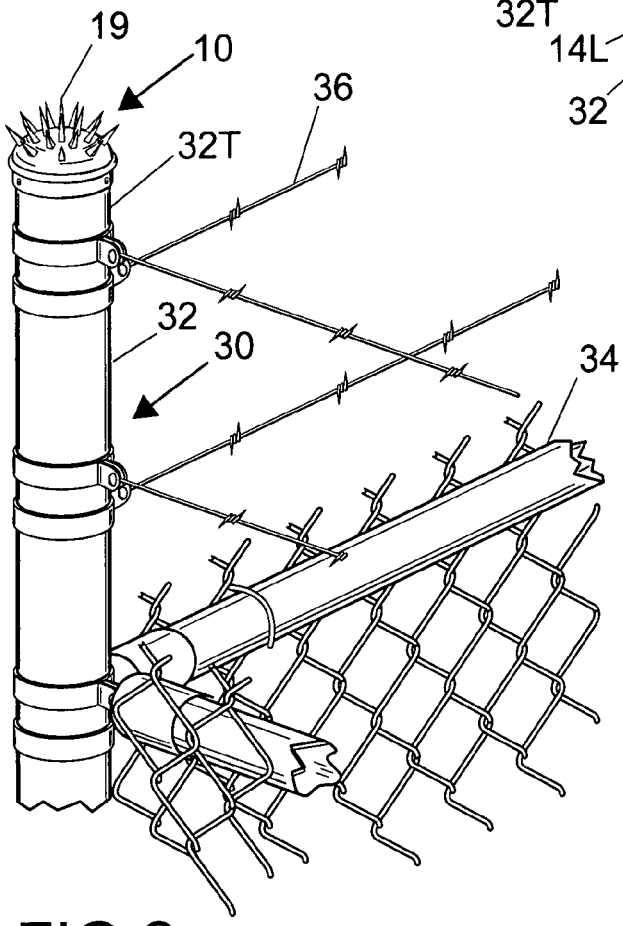
FIG. 2 is a diagrammatic perspective view, illustrating a chain link fence, with the present invention installed thereon.

FIG. 2 illustrates a chain-link fence 30 having a post 32 extending vertically, an upper rail 34 extending horizontally from the post 32, and a chain-link mesh 34 extending across below the upper rail 34. The post 32 is made of metal pipe, and has a post top 32T. In addition, sharp wire, such as barbed wire 36 extends horizontally from the post 32 above the upper rail. In accordance with the present invention, the security fence cap 10 is mounted to the post top 32T. With the spiked protrusions 19 extending radially outward from the security cap 10, the chain-link fence 30 can serve as an effective barrier to prevent would-be wrongdoers from climbing over the fence 30. As used herein with regard to the spiked protrusions 19 'extending radially', what is meant is either extending from the actual theoretical center of the domed portion, or from another arbitrary center point.

Figure 3:
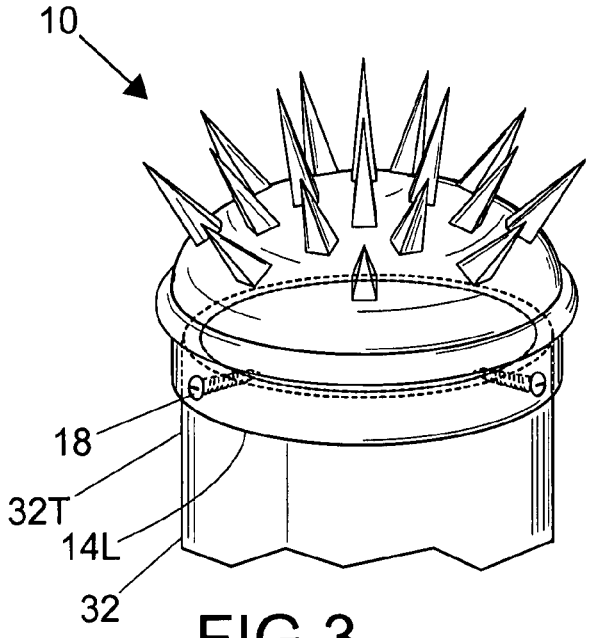
FIG. 3 is a diagrammatic perspective view, detailing the installation of the present invention atop a fence post.

FIG. 3 details interconnection of the security cap 10 and post 32. In particular, the collar 14 has a lower opening 14L. The post top 32T of the fence post 32 is extended upwardly into the lower opening 14L wherein it is closely accommodated by the collar 14. The set screws 18 extend inwardly to fasten against the fence post 32. In particular, the set screws 18 are tightened until they closely engage the pipe. In addition, the fence post can be predrilled with holes to allow the set screws 18 to extend radially into the post 32 to more effectively secure the cap 10 thereto.

Figure 4:
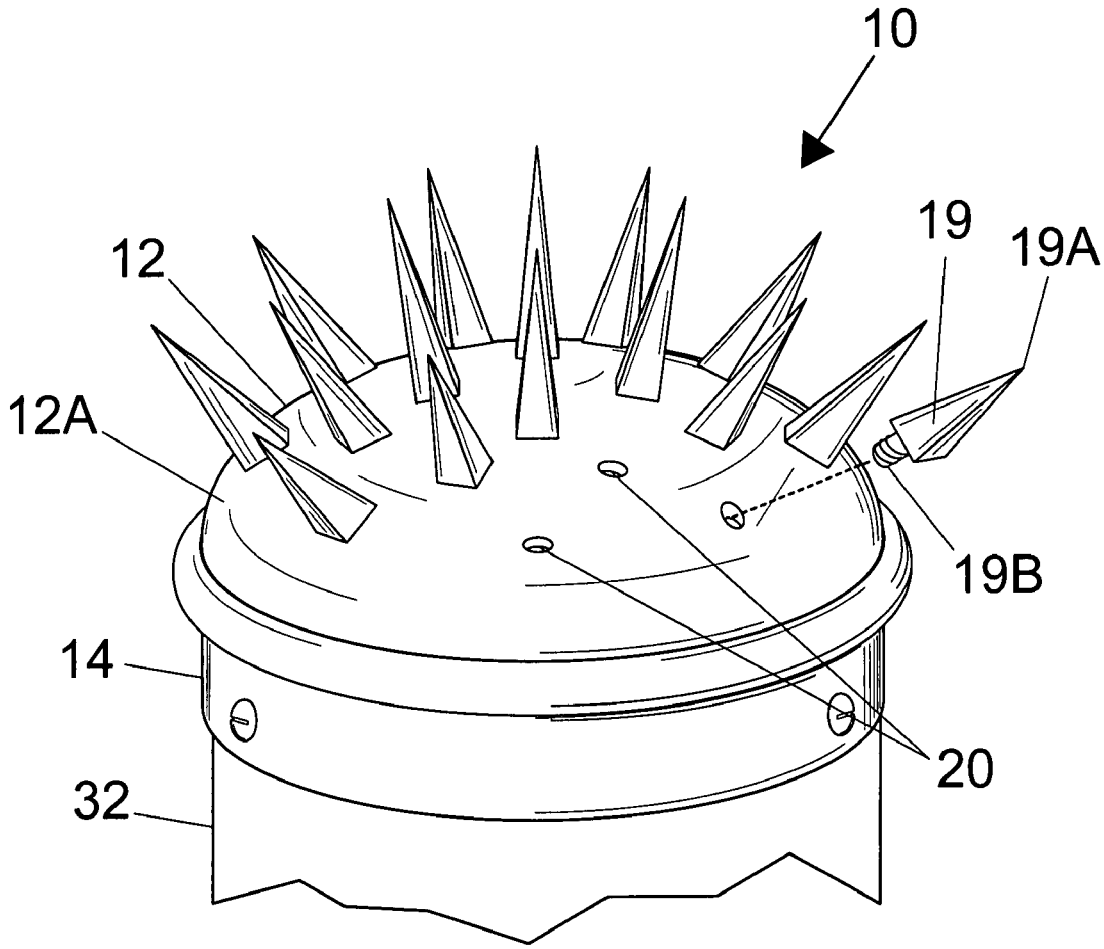
FIG. 4 is a diagrammatic perspective view, illustrating the installation of spiked protrusions onto a domed portion of the present invention, following its installation onto the fence post.

Referring now to FIG. 4, a further safety feature of the security fence cap 10 is illustrated. In particular, to prevent injury during installation of the security fence cap 10, the spiked protrusions 19 are removable from the doped portion 12. Preferably in fact, the spiked protrusions 19 are not present on the domed portion when the security cap 10 is being installed onto the post 32. Accordingly, the domed portion 12 has a plurality of threaded radial bores 20 extending inwardly from the outer surface 12A. The spiked protrusions 19 each have a threaded rod 19B extending fully opposite from the point 19A. The threaded rods 19B thereby facilitate attaching the spiked protrusions 19 to the domed portion 12 after the collar 14 has been installed onto the post 32.

In use, then, the security fence cap 10 is secured onto the post top 32T of the fence post 32 of the fence 30 by inserting the post top 32T into the lower opening 14L of the collar 14. The collar 14 is secured to the post top 32T using the set screws 18. Then the spiked protrusions are attached to the domed portion 12 by threading the threaded rod 19B of each of the spiked protrusions 19 into the threaded radial bores 20 of the domed portion. Then, the fence 30 is ready to prevent an unauthorized person from climbing over the fence 30.

In conclusion, herein is presented a security fence cap for preventing a person from using a fence post cap as a handhold while seeking to avoid the security features of a fence. The invention is illustrated by example in the drawing figures, and throughout the written description. It should be understood that numerous variations are possible, while adhering to the inventive concept. Such variations are contemplated as being a part of the present invention.

What is claimed is:

1. A security fence cap, for use with a security fence having a cylindrical post having a post top, a top rail, and sharp wire extending horizontally above the top rail, comprising:

a cylindrical collar portion, having an external surface and having a lower opening for accepting the post top therein for attaching atop the post, and further having at least one set screw extending radially inward from the external surface to tighten against the post when inserted through the lower opening;

a domed portion attached to the cylindrical collar portion, for fully covering the post top when attached on the post, the domed portion having an outer surface that is semispherical having a plurality of radial bores; and a plurality of spiked protrusions, each spiked protrusion has a point at one end and a threaded rod at an opposite end, the threaded rod selectively secures each of said spiked protrusions within one of the radial bores of the domed portion and allows it to be removed therefrom, each spiked protrusion individually extending radially outward from the semispherical outer surface of the domed portion.

* * * * *